US011530118B2

(12) United States Patent
Henriksson et al.

(10) Patent No.: US 11,530,118 B2
(45) Date of Patent: Dec. 20, 2022

(54) CONTAINER CRANE COMPRISING REFERENCE MARKER

(71) Applicant: ABB Schweiz AG, Baden (CH)

(72) Inventors: Björn Henriksson, Västerås (SE); Uno Bryfors, Västerås (SE)

(73) Assignee: ABB Schweiz AG, Baden (CH)

( * ) Notice: Subject to any disclaimer, the term of this patent is extended or adjusted under 35 U.S.C. 154(b) by 381 days.

(21) Appl. No.: 16/800,425

(22) Filed: Feb. 25, 2020

(65) Prior Publication Data

US 2020/0270104 A1 Aug. 27, 2020

(30) Foreign Application Priority Data

Feb. 25, 2019 (EP) ..... 19158979

(51) Int. Cl.
*B66C 13/16* (2006.01)
*B66C 19/00* (2006.01)
(Continued)

(52) U.S. Cl.
CPC ..... *B66C 13/16* (2013.01); *B66C 13/08* (2013.01); *B66C 13/18* (2013.01); *B66C 13/46* (2013.01); *B66C 19/002* (2013.01); *B66C 19/007* (2013.01)

(58) Field of Classification Search
CPC ..... B66C 13/16; B66C 13/08; B66C 13/18; B66C 13/46; B66C 19/002; B66C 19/007; B66C 13/48; B66C 19/00
See application file for complete search history.

(56) References Cited

U.S. PATENT DOCUMENTS 5,142,658 A * 8/1992 McMorran ..... B65G 63/004 340/687
5,661,465 A * 8/1997 Hung ..... G01S 5/16 340/686.2
(Continued)

FOREIGN PATENT DOCUMENTS

CN 106629398 A 5/2017
CN 108263950 A 7/2018
(Continued)

OTHER PUBLICATIONS

European Patent Office, Extended Search Report issued in corresponding Application No. 19158979.5, dated Sep. 26, 2019, 9 pp.

*Primary Examiner* — Gregory W Adams
(74) *Attorney, Agent, or Firm* — Leydig, Voit & Mayer, Ltd.

(57) ABSTRACT

It is provided a container crane including: a spreader configured to controllably attach to a container; a container trolley to which the spreader is attached via cables, the container trolley being provided on an upper part of the container crane and being horizontally movable along a first direction; a first sensor arrangement mounted on the container trolley, the first sensor arrangement being usable to determine a position of the container; a second sensor arrangement being usable to determine a position of a target; and at least one reference marker provided fixed, in at least two dimensions, to a horizontal support provided along the first direction between vertical structures of the container crane, the at least one reference marker being provided vertically lower than the first sensor arrangement and the at least one reference marker being detectable by the first sensor arrangement.

17 Claims, 5 Drawing Sheets

(51) Int. Cl.

| | |
|---|---|
| ***B66C 13/18*** | (2006.01) |
| ***B66C 13/46*** | (2006.01) |
| ***B66C 13/08*** | (2006.01) |

(56) References Cited

U.S. PATENT DOCUMENTS

| | | | | |
|---|---|---|---|---|
| 6,057,777 | A * | 5/2000 | Dunne | B66C 13/46 340/436 |
| 7,123,132 | B2 * | 10/2006 | Heidenback | G01B 11/272 340/686.2 |
| 8,267,264 | B2 * | 9/2012 | Bryfors | B66C 19/002 212/270 |
| 9,221,655 | B2 * | 12/2015 | Kouhia | B66C 13/46 |
| 9,511,983 | B2 * | 12/2016 | Eidenberger | B66C 17/00 |
| 2008/0110844 | A1 * | 5/2008 | Lewis | B66C 13/48 212/270 |
| 2015/0191333 | A1 * | 7/2015 | Kouhia | G01S 17/42 356/614 |
| 2018/0050889 | A1 * | 2/2018 | Fakkeldij | F16F 7/1011 |
| 2018/0170720 | A1 | 6/2018 | Mannari et al. | |

FOREIGN PATENT DOCUMENTS

| | | | | |
|---|---|---|---|---|
| DE | 4403898 | A1 * | 8/1994 | B66C 13/46 |
| DE | 20220364 | U1 | 6/2003 | |
| DE | 102006044187 | A1 | 4/2008 | |
| DE | 102007060856 | A1 | 7/2009 | |
| EP | 1307396 | B1 | 11/2004 | |
| EP | 2102089 | B1 | 4/2010 | |
| EP | 2910512 | B1 | 5/2016 | |
| JP | H05246683 | A | 9/1993 | |
| JP | 2000169078 | A * | 6/2000 | |
| JP | 5039385 | B2 | 10/2012 | |

* cited by examiner

CONTAINER CRANE COMPRISING REFERENCE MARKER

TECHNICAL FIELD

The present disclosure relates to the field of container cranes and in particular to accurate positioning of a target for landing or picking up a container, using at least one reference marker.

BACKGROUND

Container cranes are used to handle freight containers, to transfer containers between transport modes at container terminals, freight harbours and the like. Standard shipping containers are used to transport a great and growing volume of freight around the world. Trans-shipment is a critical function in freight handling. Trans-shipment may occur at each point of transfer and there is usually a tremendous number of containers that must be unloaded, transferred to a temporary stack, and later loaded on to another ship, or back onto the same ship or loaded instead onto another form of transport such as a road vehicle or train.

Traditionally, the container cranes have been controlled in an operator cabin mounted on the container crane. Recently however, container cranes have become remote controlled and even fully automated. This reduces or eliminates the need for crane operators being exposed to inconvenience, danger and even injury of being located on a container crane.

However, with ever increasing sizes of container cranes, accurate positioning of containers and targets becomes increasingly difficult. When fully automated systems are being deployed for landing or picking up containers e.g. in relation to vehicle chassis, it is of utmost importance that positioning of load and target is accurate, as any mistake can lead to a container damaging the vehicle or even drivers in the driver cabin.

SUMMARY

One objective is to improve accuracy in positioning a target for landing or picking up a container.

According to a first aspect, it is provided a container crane comprising: a spreader configured to controllably attach to a container; a container trolley to which the spreader is attached via cables, the container trolley being provided on an upper part of the container crane and being horizontally movable along a first direction; a first sensor arrangement mounted on the container trolley, the first sensor arrangement being usable to determine a position of the container; a second sensor arrangement being usable to determine a position of a target; and at least one reference marker provided fixed, in at least two dimensions, to a horizontal support provided along the first direction between vertical structures of the container crane, the at least one reference marker being located vertically lower than the first sensor arrangement and being detectable by the first sensor arrangement.

The second sensor arrangement may be attached to the upper part of the container crane in which case the at least one reference marker is detectable by the second sensor arrangement.

The second sensor arrangement may be provided fixed, in at least two dimensions, to the horizontal support.

The second sensor arrangement may be provided on a sensor trolley, being movable along the horizontal support, in which case the at least one reference marker is provided on the sensor trolley.

The second sensor arrangement may comprise a plurality of sensors fixed to the horizontal support, in which case the at least one reference marker is provided fixed to the horizontal support.

The container crane may comprise two reference markers respectively provided fixed, in at least two dimensions, to the horizontal supports, each of which are provided along the first direction between vertical structures of the container crane.

The container crane may be a ship-to-shore crane.

The target may be a vehicle.

The distance from ground to a boom of the container crane may be greater than 50 metres.

The at least one reference marker may be both optically distinguishable and structurally distinguishable.

The horizontal support may be a crossbeam.

According to a second aspect, it is provided a method performed in a coordinator device. The method comprises the steps of: detecting a reference marker using a first sensor arrangement to determine a position of the first sensor arrangement relative the reference marker, the first sensor arrangement forming part of a container crane further comprising: a spreader configured to controllably attach to a container, a container trolley to which the spreader is attached via cables, the container trolley being provided on an upper part of the container crane and being horizontally movable along a first direction, wherein the first sensor arrangement is mounted on the container trolley; determining the position of a second sensor arrangement, being usable to determine a position of a target, in relation to the reference marker; and determining relative position between the first sensor arrangement and the second sensor arrangement based on the relative position between the first sensor arrangement and the reference marker, and the relative position between the second sensor arrangement and the reference marker, wherein the reference marker is provided fixed, in at least two dimensions, to one of a horizontal support provided along the first direction between vertical structures of the container crane.

According to a third aspect, it is provided a computer program comprising computer program code which, when run on a coordinator device causes the coordinator device to: detect a reference marker using a first sensor arrangement to determine a position of the first sensor arrangement relative the reference marker, the first sensor arrangement forming part of a container crane further comprising: a spreader configured to controllably attach to a container, a container trolley to which the spreader is attached via cables, the container trolley being provided on an upper part of the container crane and being horizontally movable along a first direction, wherein the first sensor arrangement is mounted on the container trolley; determine the position of a second sensor arrangement, being usable to determine a position of a target, in relation to the reference marker; and determine relative position between the first sensor arrangement and the second sensor arrangement based on the relative position between the first sensor arrangement and the reference marker, and the relative position between the second sensor arrangement and the reference marker, wherein the reference marker is provided fixed, in at least two dimensions, to one of the a horizontal support provided along the first direction between vertical structures of the container crane.

According to a fourth aspect, it is provided a computer program product comprising a computer program according to third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

Aspects and embodiments are now described, by way of example, with reference to the accompanying drawings, in which.

DETAILED DESCRIPTION

The aspects of the present disclosure will now be described more fully hereinafter with reference to the accompanying drawings, in which certain embodiments of the invention are shown. These aspects may, however, be embodied in many different forms and should not be construed as limiting; rather, these embodiments are provided by way of example so that this disclosure will be thorough and complete, and to fully convey the scope of all aspects of invention to those skilled in the art. Like numbers refer to like elements throughout the description.

Figure 1:
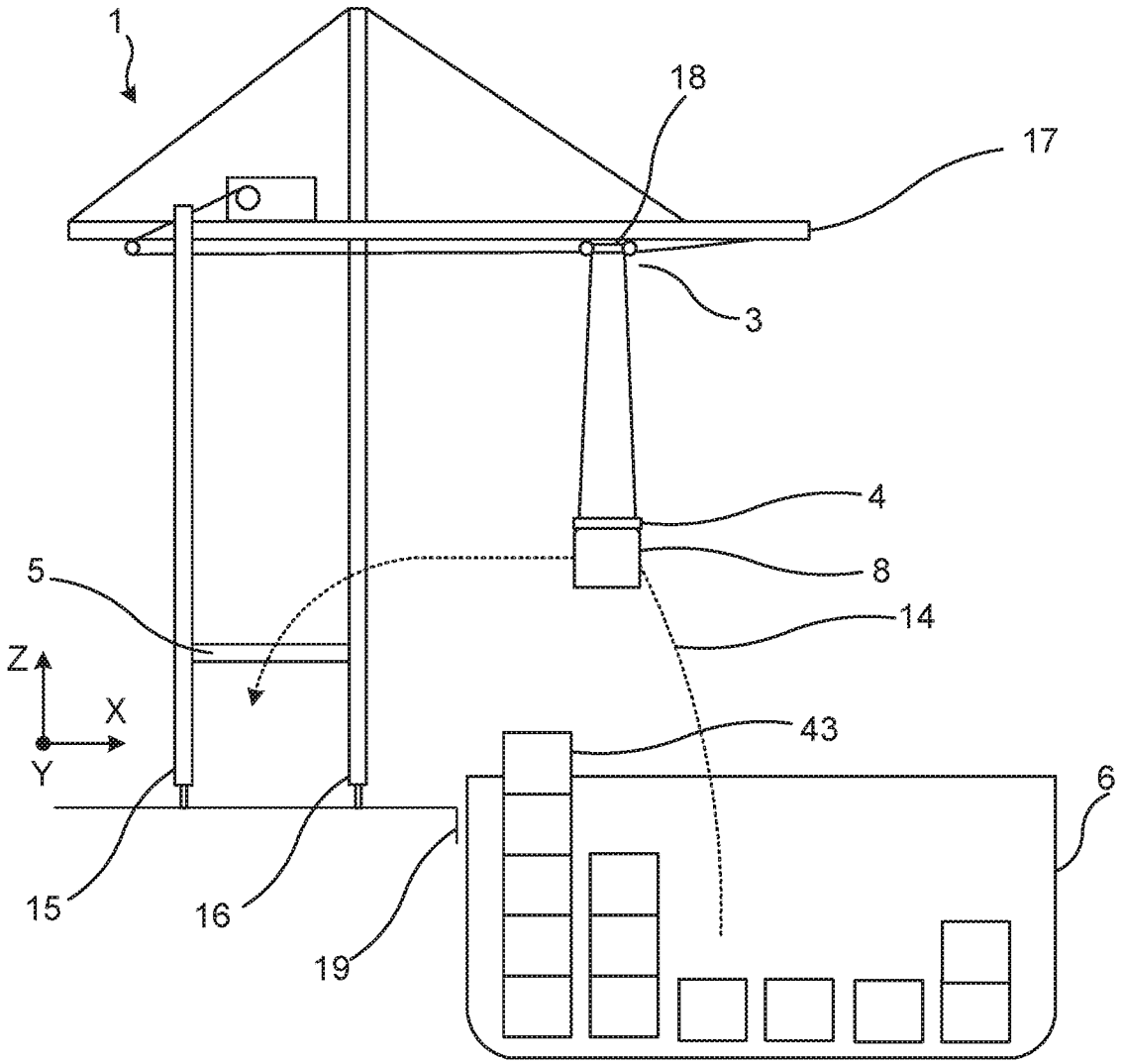
FIG. 1 is a schematic diagram illustrating an environment in which embodiments presented herein can be applied.

FIG. 1 is a schematic diagram illustrating an environment in which embodiments presented herein can be applied. It is here shown a ship 6 comprising a number of containers and a container crane 1. The container crane 1 can thus be a ship to shore crane. The container crane 1 is shown to have a boom 17 at the upper part 7 of the container.

A spreader 4 is configured to controllably attach to a container 8. The spreader 4 is attached to a container trolley 3 via cables. The container trolley 3 is provided on an upper part of the container crane 1, such as the boom 17, and is horizontally (and linearly) movable along a first direction, which is the X direction in the coordinate system indicated in the Figures. This first direction is also known as gantry direction.

Hence, the boom 17 supports a container trolley 3 such that it can move back and forth in the first direction. It is to be noted that the container crane 1 can be provided with multiple spreaders for simultaneous movement of multiple containers.

The container crane 1 lifts the container 8, for example, out of the ship 6 and along a path, to land the container 8 on target which can be a truck or other vehicle (not shown), another container, or a landing place such as a ground slot. The container crane runs on rails under each set 15, 16 of legs in a direction in or out of the plane of the paper, indicated as a Y direction. The quay 19 is also shown.

A lower horizontal support 5 in the form of a crossbeam is provided to provide stability to the structure of the container crane 1. In fact, there are two lower horizontal supports in the form of crossbeams in the first (X) direction, as is seen better in FIG. 2. The horizontal support(s) are used to support reference markers, as described in more detail below. In one embodiment, the (one or more) horizontal supports are in the form of a wire between the vertical structures of the container crane. Each horizontal support 5 is provided essentially horizontally between vertical structures of the container crane 1, more specifically between a back leg 15 and a front leg 16. The container crane 1 also comprises two upper crossbeams 9, each provided horizontally between a front leg and a back leg.

The container crane 1 is very high. The distance from ground (the quay 19) to the boom 17 can be greater than 50 metres and can even be 60 metres or more. The horizontal support, and thus the reference marker, may be provided at a lower height, typically lower than half of the boom 17 height. Preferably, the reference marker is located approximately 10-15 metres above ground.

Figure 2:
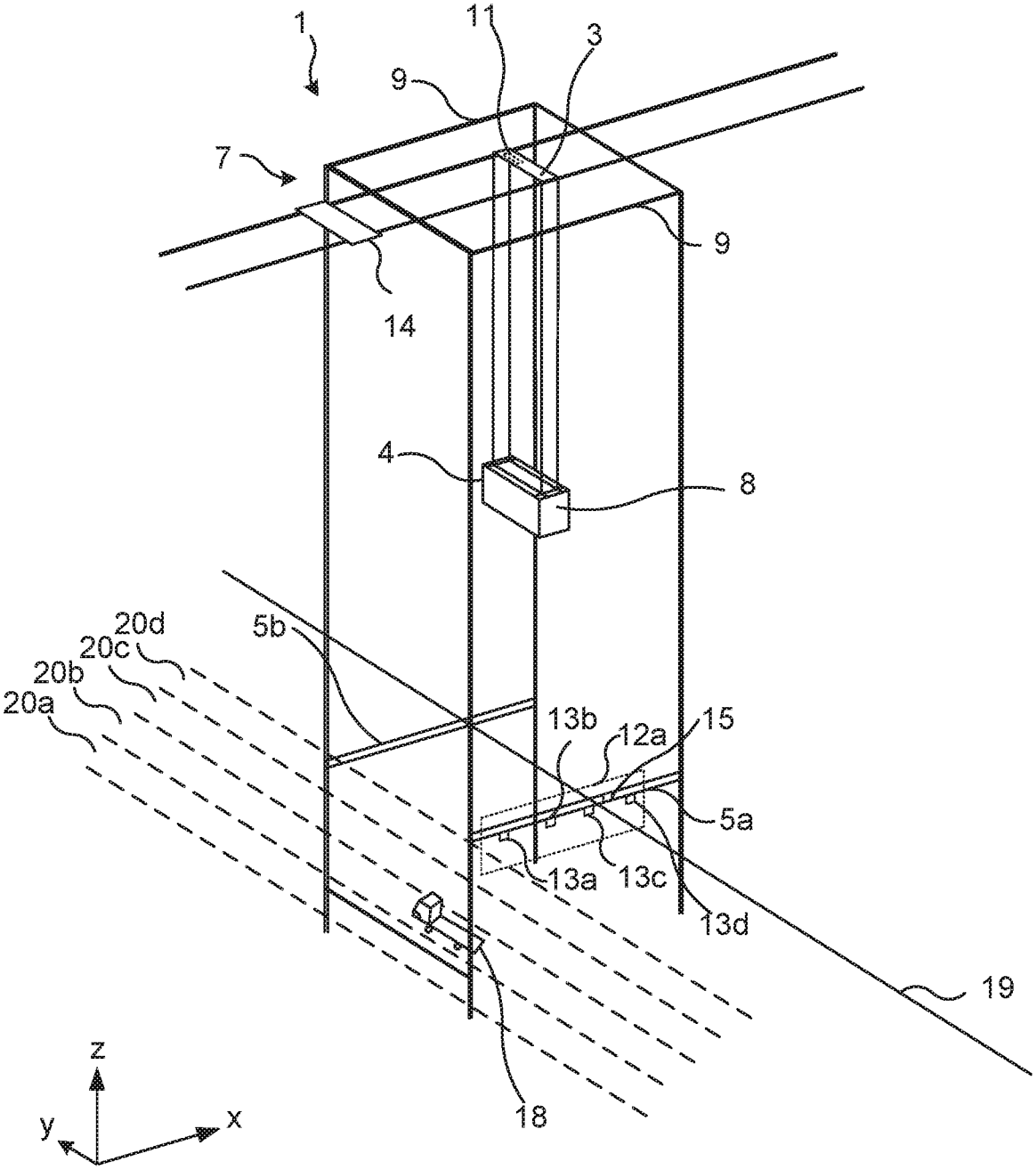
FIG. 2 is a perspective view of an embodiment of the container crane of FIG. 1 comprising a reference marker on a horizontal support.

FIG. 2 is a perspective view of an embodiment of the container crane of FIG. 1 comprising a reference marker on a horizontal support, here illustrated as a crossbeam. Neither the parts above the container trolley 3 nor the full extent of the boom are shown here, for reasons of clarity. Here, the distinction between the two horizontal supports 5*a-b* is clearly shown.

Under the container crane 1, there are here four vehicle lanes 20*a-d*, where vehicles can pass and stop. When a vehicle is stationary, the container crane 1 can be used to land a container on the vehicle or to pick up a container from the vehicle. It is to be noted that while four vehicle lanes 20*a-d* are shown here, any suitable number of vehicle lanes can be provided.

A first sensor arrangement 11 is provided on the container trolley 3. The first sensor arrangement n is used to determine a current position of the load, i.e. the container 8. The first sensor arrangement n can be based on a camera, such as a CCD (Charge-coupled device).

In the example illustrated in FIG. 2, the container 8 is to be landed on a target 18, in this case on a chassis of a vehicle. The target 18 is here in the second vehicle lane 2*b*.

In order to provide accurate positioning of the target 18 for landing or picking up a container, a second sensor arrangement 12*a* is provided. The purpose of the second sensor arrangement 12*a* is to accurately find the position of the target 18, where the container 8 is to be landed. For picking up containers, the container to be picked up is the target for the spreader 4, and the position of the container to be picked up is thus determined by the second sensor arrangement 12*a*.

In this embodiment, the second sensor arrangement 12*a* is provided fixed to one of the (lower) horizontal supports 5*a*, 5*b*. The second sensor arrangement 12*a* here comprises a plurality of sensors 13*a-d* fixed to the first horizontal support 5*a*. Each one of the sensors 13*a-d* is used for a subset of the vehicle lanes 20*a-d*. In this example, there is one sensor for each vehicle lane. However, there could be fewer or more sensors than vehicle lanes 20*a-d*.

Since the position of the container 8 and spreader 4 is determined by the first sensor arrangement 11 and the position of the target 18 is determined by the second sensor arrangement 12*a*, the container 8 can be landed on the target 18. However, there needs to be an accurate way to determine the relative position between these two sensor arrangements 11, 12*a* for these two to work in harmony. For this purpose, at least one reference marker 15 is provided fixed, in at least two dimensions, to one of the horizontal supports. In other words, the reference marker is blocked from moving in at least two dimensions and can thus be linearly movable (when fixed in two dimensions) or immovable (when fixed in three dimensions). The at least one reference marker 15 is provided vertically lower (i.e. closer to ground) than the first sensor arrangement. The at least one reference marker 15 may be provided at 20-30% of the height of the first sensor arrangement. The reference marker is detectable by the first sensor arrangement 11. The reference marker 15 is fixed in relation to the second sensor arrangement 12*a*. A coordinator device 14 is provided to coordinate the positions of the two sensor arrangements 11, 12*a* in relation to the reference marker 15, and thus to each other. This allows accurate control movement of the container 8 to be positioned on the target 18 e.g. using autonomous control.

Optionally, reference markers 15 are provided on both horizontal supports. This allows any skew between the container crane and vehicles to be accurately determined and used in calculations.

Figure 3:
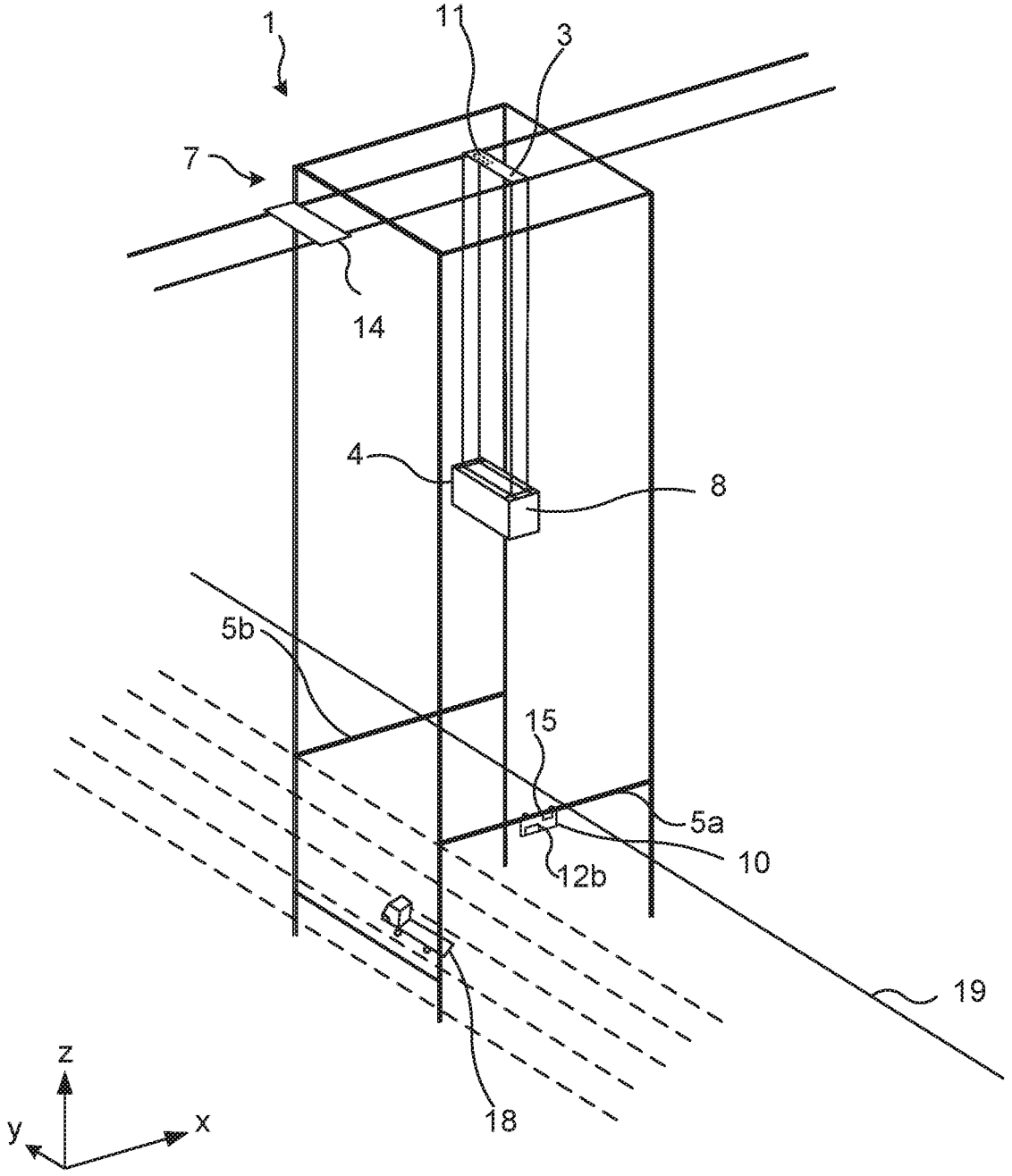
FIG. 3 is a perspective view of an embodiment of the container crane of FIG. 1 comprising a reference marker on a sensor trolley on a horizontal support.

FIG. 3 is a perspective view of an embodiment of the container crane of FIG. 1 comprising a reference marker on a sensor trolley 10 on a horizontal support, here illustrated as a crossbeam. FIG. 3 is similar to FIG. 2 and only differences with the embodiment of FIG. 2 will be described. The sensor trolley 10 is movable along one of the horizontal (lower) horizontal supports 5*a-b* of the container crane 1. The second sensor arrangement 12*b* is here provided on the sensor trolley 10. In this way, the sensor arrangement 12*b* is movable to cover a plurality of the vehicle lanes 20*a-f* under the container crane 1. A reference marker 15 is provided on the sensor trolley 10, detectable by the first sensor arrangement 11. Also here, the reference marker 15 is provided vertically lower than the first sensor arrangement.

Optionally, two sensor trolleys 10 can be provided on the respective horizontal supports 5*a-b* to give greater accuracy of positioning the target 18.

A common feature of the embodiments of FIG. 2 and FIG. 3, is that the second sensor arrangement 12*a*, 12*b* is provided fixed, in at least two dimensions, to one of the horizontal supports 5*a-b*. In the embodiment of FIG. 2, the sensor arrangement 12*a* is fixed in three dimensions, i.e. fixed to, one of the horizontal supports. In the embodiment of FIG. 3, the sensor arrangement 12*b* is fixed in two dimensions, and is thus linearly movable along one dimension, X.

Furthermore, the reference marker is fixed in relation to the second sensor arrangement, whereby only the first sensor arrangement need to detect and determine the position of the reference marker to establish relative position between the first sensor arrangement 11 and the second sensor arrangement.

Figure 4:
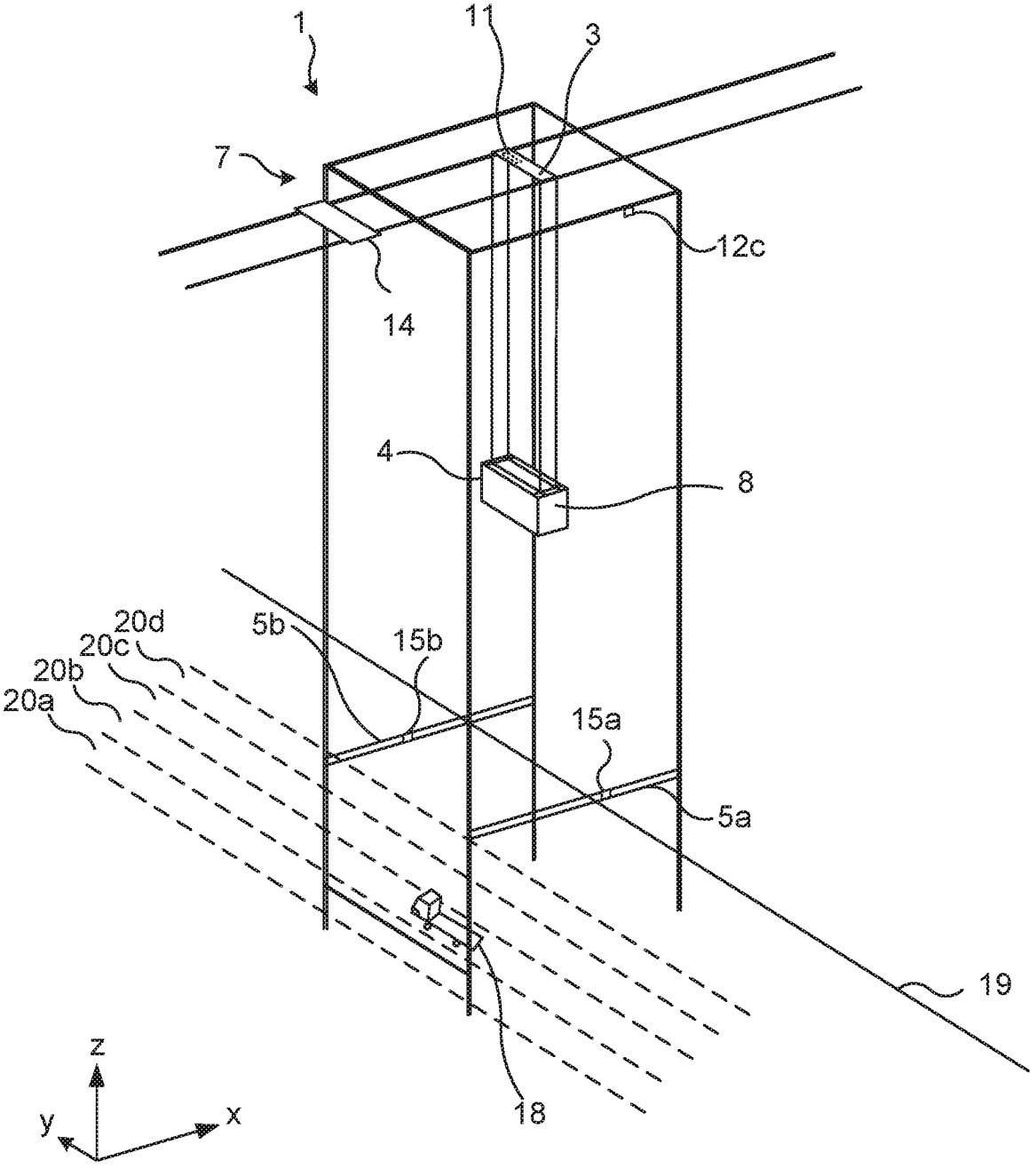
FIG. 4 is a perspective view of an embodiment of the container crane of FIG. 1 where the second sensor arrangement is attached to the upper part of the container crane.

FIG. 4 is a perspective view of an embodiment of the container crane of FIG. 1 where the second sensor arrangement 12C is attached to the upper part of the container crane 1. For instance, the second sensor arrangement 12C can be fixedly attached to the structure of the container crane 1 at essentially the same height as the gantry.

In this embodiment, a first reference marker 15*a* is provided on the first horizontal support 5*a*, here illustrated as a crossbeam. A second reference marker 15*b* is provided on the second horizontal support 5*b*, here also illustrated as a crossbeam, whereby the at least one reference marker 15 is provided vertically lower than the first sensor arrangement. The reference markers 15*a-b* are detectable by the second sensor arrangement 12C, as well as by the first sensor arrangement 11.

It is to be noted that while the embodiments of FIGS. 2 and 3 are shown with one reference marker and the embodiment of FIG. 4 is shown with two reference markers, any embodiment can be provided with any number of reference markers, as long as there is at least one.

The reference markers 15 mentioned above in all embodiments can be an optical, i.e. visual and/or light emitting, reference marker to be identifiable by a camera. When the reference marker comprises a light emitting reference marker, this can be configured to provide a distinguishable light pattern by controlling when the light source is on or off, e.g. blinking pattern. The reference markers can also be of a particular geometrical shape that allows a 3D sensor to detect the reference marker, i.e. structurally distinguishable. In this way, the reference markers are clearly identifiable by the first sensor arrangement 11 and, especially for the embodiment of FIG. 4, identifiable also by the second sensor arrangement 12C. In one embodiment, the reference markers 15 are both optically distinguishable and structurally distinguishable.

It is to be noted that the coordinator device 14 can be implemented as a stand-alone device, as shown in FIGS. 2-4, or embodied as part of another device, such as the first sensor arrangement 11, or the second sensor arrangement 12*a-c*.

Figure 5:
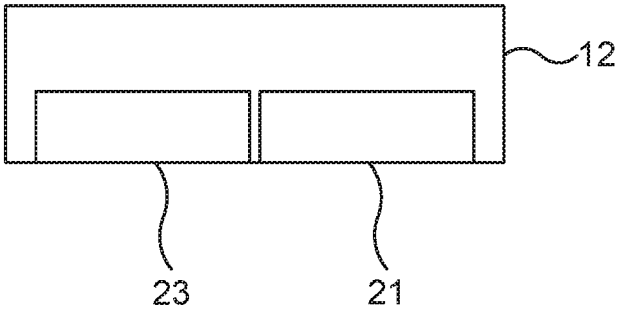
FIG. 5 is a schematic diagram of the second sensor arrangement of any one of the embodiments of FIGS. 2 to 4.

FIG. 5 is a schematic diagram of the second sensor arrangement 12, being any one of the second sensor arrangements 12*a-c* of the embodiments of FIGS. 2 to 4. The second sensor arrangement 12 is usable to determine a position of a target 18 for landing or picking up a container 8.

The sensor arrangement 12 can comprise a three dimensional (3D) structure sensor 23, such as a LIDAR (Light Detection and Ranging) system 23, capable of generating 3D representation containing the target 18. The LIDAR system can comprises two LIDARs arranged cross-wise. Alternatively or additionally, the 3D structure sensor 23 is based on a two-dimensional (2D) laser, radar or image processing.

The sensor arrangement 12 can also comprise a camera 21 for identifying vehicles and/or containers. The camera 21 can e.g. be a pan-tilt-zoom (PTZ) camera. The vehicles may have visual markers to allow identification with the camera 21. This allows a current vehicle to be identified, as well as any vehicles waiting in line. The containers can be identified e.g. by capturing an image of a container identifier (such as a container number) on the short end of the container. Also, placards (such as for dangerous goods) and door direction of containers can be identified and recorded. Images of the container can be stored for later verification in terms of damage management.

The second sensor arrangement 12 keeps track of the position, movement and orientation of the vehicles in the area under the container crane. The driver can in this way safely remain in the vehicle when the load is automatically landed on the chassis. The second sensor arrangement 12 can also register the next vehicle in line.

Optionally, if the second sensor arrangement 12 detects that the vehicle is moving when the container is about to be landed or picked up, a signal is generated which causes the container crane to quickly hoist the spreader (which may carry a container) up again to prevent damage to equipment or people.

Using the embodiments presented herein, accurate positioning of the target in relation to the container is provided. The reference markers allow highly accurate relative positioning between the first sensor arrangement 11 and the second sensor arrangement 12, 12*a-c*. This allows coordinate systems by the first sensor arrangement 11 and the second sensor arrangement 12, 12*a-c* to be coordinated with an accuracy of 3 cm or less, even when the container crane height is 60 metres or more. Moreover, the positioning can be used to ensure coordination between the coordinate systems of the first sensor arrangement 11 and the second sensor arrangement 12*a-c*, and this coordination can be performed quickly. Hence, the coordination can be repeated often, virtually continuously, to thereby adapt to slight variations in geometry in the crane over time, which may occur e.g. due to crane movement along rails and/or weather conditions.

Figure 6:
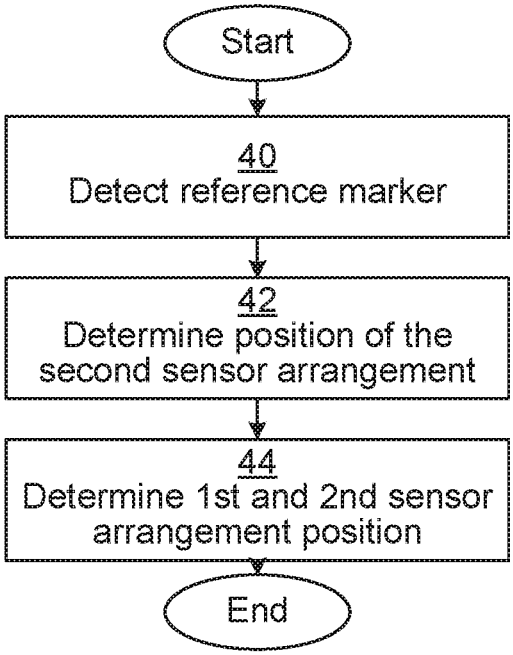
FIG. 6 is a flow chart illustrating a method performed in the coordinator device to determine a relative position between the first sensor arrangement and the second sensor arrangement.

FIG. 6 is a flow chart illustrating a method performed in the coordinator device to determine a relative position between the first sensor arrangement and the second sensor arrangement.

In a detect reference marker step 40, the coordinator device detects a reference marker using a first sensor arrangement to thereby determine a position of the first sensor arrangement relative the reference marker. As described above, the first sensor arrangement forms part of a container crane, and the container crane further comprises: a spreader configured to controllably attach to a container, a container trolley to which the spreader is attached via cables. The container trolley is provided on an upper part of the container crane and is horizontally movable along a first direction. The first sensor arrangement is mounted on the container trolley. As explained above, the at least one reference marker is provided vertically lower than the first sensor arrangement to allow detection by the first sensor.

In a determine position of the second sensor arrangement step 42, the coordinator device determines the position of a second sensor arrangement. As explained above, the second sensor arrangement is usable to determine a position of a target, in relation to the reference marker. The position of the second sensor arrangement can be determined by the reference marker being fixed in relation to the second sensor arrangement, in which case the relative position is a constant. In one embodiment (e.g. as shown in FIG. 4 and mentioned above), this step comprises detecting the position of the reference marker e.g. by 3D detection of the physical structure of the reference marker.

In a determine $1^{st}$ and $2^{nd}$ sensor arrangement position step 44, the coordinator device determines relative position between the first sensor arrangement and the second sensor arrangement based on the relative position between the first sensor arrangement and the reference marker, and the relative position between the second sensor arrangement and the reference marker, wherein the reference marker is provided fixed, in at least two dimensions, to a horizontal support provided along the first direction x between vertical structures of the container crane.

Figure 7:
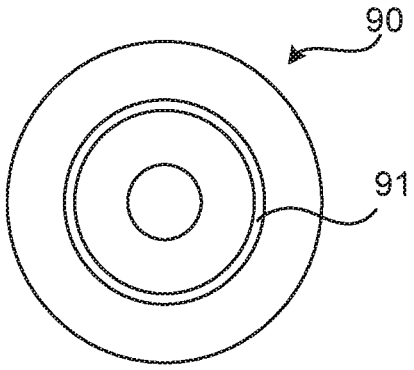
FIG. 7 shows one example of a computer program product 90 comprising computer readable means.

FIG. 7 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as a memory in the coordinator device 14 of FIGS. 2-4. While the computer program 91 is here schematically shown as a track on the depicted optical disk, the computer program can be stored in any way which is suitable for the computer program product, such as a removable solid state memory, e.g. a Universal Serial Bus (USB) drive.

The aspects of the present disclosure have mainly been described above with reference to a few embodiments. However, as is readily appreciated by a person skilled in the art, other embodiments than the ones disclosed above are equally possible within the scope of the invention, as defined by the appended patent claims. Thus, while various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A container crane comprising:

a spreader configured to controllably attach to a container;

a container trolley to which the spreader is attached via cables, the container trolley being provided on an upper part of the container crane and being horizontally movable along a first direction;

a first sensor arrangement mounted on the container trolley, the first sensor arrangement being usable to determine a position of the container;

a second sensor arrangement being usable to determine a position of a target; and at least one reference marker provided fixed, in at least two dimensions, to a horizontal support provided along the first direction between vertical structures of the container crane, the at least one reference marker being provided vertically lower than the first sensor arrangement and the at least one reference marker being detectable by the first sensor arrangement, and wherein the second sensor arrangement is provided on a sensor trolley, being movable along the horizontal support, and wherein the at least one reference marker is provided on the sensor trolley, or wherein the second sensor arrangement comprises a plurality of sensors fixed to the horizontal support and wherein the at least one reference marker is provided fixed to the horizontal support.

2. The container crane according to claim 1, wherein the second sensor arrangement is provided fixed, in at least two dimensions, to the horizontal support.

3. The container crane according to claim 2, comprising two reference markers respectively provided fixed, in at least two dimensions, to two horizontal supports, each of which are provided along the first direction between vertical structures of the container crane.

4. The container crane according to claim 1, comprising two reference markers respectively provided fixed, in at least two dimensions, to two horizontal supports, each of which are provided along the first direction between vertical structures of the container crane.

5. The container crane according to claim 1, wherein the container crane is a ship-to-shore crane.

6. The container crane according to claim 1, wherein the target is a vehicle.

7. The container crane according to claim 1, wherein the distance from ground to a boom of the container crane is greater than 50 metres.

8. The container crane according to claim 1, wherein the at least one reference marker are both optically distinguishable and structurally distinguishable.

9. The container crane according to claim 1, wherein the horizontal support is a crossbeam.

10. A method performed in a coordinator device for controlling at least one container crane according to claim 1, the method comprising the steps of:

detecting the reference marker using the first sensor arrangement to determine a position of the first sensor arrangement relative the reference marker, the first sensor arrangement forming part of the container crane including the spreader configured to controllably attach the container and the container trolley to which the spreader is attached via cables, the container trolley being provided on the upper part of the container crane and being horizontally movable along the first direction, wherein the first sensor arrangement is mounted on the container trolley and wherein the at least one reference marker is provided vertically lower than the first sensor arrangement;

determining a position of the second sensor arrangement, being usable to determine the position of the target, in relation to the reference marker; and determining relative position between the first sensor arrangement and the second sensor arrangement based on the relative position between the first sensor arrangement and the reference marker, and the relative position between the second sensor arrangement and the reference marker, wherein the reference marker is provided fixed, in at least two dimensions, to the horizontal support provided along the first direction between vertical structures of the container crane.

11. A memory device comprising:

a set of instructions executable by a processor of a coordinator device effective to control at least one container crane according to claim 1, the set of instructions effective to:

detect the reference marker using the first sensor arrangement to determine a position of the first sensor arrangement relative the reference marker, the first sensor arrangement forming part of the container crane including the spreader configured to controllably attach to the container and the container trolley to which the spreader is attached via cables, the container trolley being provided on the upper part of the container crane and being horizontally movable along the first direction, wherein the first sensor arrangement is mounted on the container trolley and wherein the at least one reference marker is provided vertically lower than the first sensor arrangement;

determine a position of the second sensor arrangement, being usable to determine the position of the target, in relation to the reference marker; and determine relative position between the first sensor arrangement and the second sensor arrangement based on the relative position between the first sensor arrangement and the reference marker, and the relative position between the second sensor arrangement and the reference marker, wherein the reference marker is provided fixed, in at least two dimensions, to the horizontal support provided along the first direction between vertical structures of the container crane.

12. A computer program code comprising a computer program according to claim 11 and a computer readable means on which the computer program is stored.

13. The container crane according to claim 1, wherein the at least one reference marker is provided at a vertical height of 20-30% of the vertical height of the first sensor arrangement.

14. The container crane according to claim 1, comprising two reference markers respectively provided fixed, in at least two dimensions, to two horizontal supports, each of which are provided along the first direction between vertical structures of the container crane.

15. The container crane according to claim 14, wherein the container crane is a ship-to-shore crane.

16. The container crane according to claim 15, wherein the at least one reference marker is both optically distinguishable and structurally distinguishable.

17. The container crane according to claim 16, wherein the horizontal support is a crossbeam.

* * * * *